US009506380B2

(12) United States Patent
Zschieschang

(10) Patent No.: US 9,506,380 B2
(45) Date of Patent: Nov. 29, 2016

(54) CAMSHAFT PHASER

(71) Applicant: Schaeffler Technologies AG & Co. KG, Herzogenaurach (DE)

(72) Inventor: Torsten Zschieschang, Hagenbuechach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/786,879

(22) PCT Filed: Feb. 11, 2014

(86) PCT No.: PCT/DE2014/200055

§ 371 (c)(1),
(2) Date: Oct. 23, 2015

(87) PCT Pub. No.: WO2014/173400

PCT Pub. Date: Oct. 30, 2014

(65) Prior Publication Data

US 2016/0069226 A1 Mar. 10, 2016

(30) Foreign Application Priority Data

Apr. 26, 2013 (DE) ..... 10 2013 207 615

(51) Int. Cl.
*F01L 1/34* (2006.01)
*F01L 1/344* (2006.01)

(52) U.S. Cl.
CPC ..... *F01L 1/3442* (2013.01); *F01L 1/34409* (2013.01); *F01L 2001/34426* (2013.01); *F01L 2001/34453* (2013.01)

(58) Field of Classification Search
CPC ..... F01L 1/3442; F01L 2001/34453; F01L 2001/34426
USPC ..... 123/90.17
See application file for complete search history.

(56) References Cited

U.S. PATENT DOCUMENTS 7,931,000 B2 4/2011 Ushida et al.
2002/0078913 A1* 6/2002 Fukuhara ..... F01L 1/344 123/90.17

(Continued)

FOREIGN PATENT DOCUMENTS

DE 102007000249 10/2007
DE 102007007073 8/2008

(Continued)

*Primary Examiner* — Zelalem Eshete
(74) *Attorney, Agent, or Firm* — Davidson, Davidson & Kappel, LLC

(57) ABSTRACT

A camshaft phaser has a central-position locking device for locking the rotor in a central locking position relative to the stator. One or more of the vanes altogether have at least two pressure medium conduits each fluidically connect two working chambers of different directions of action. The pressure medium conduits have check valves of different directions of action which allow the pressure medium to be transferred in one direction and prevent it from being transferred in the respective opposite direction, depending on the direction of rotation of the rotor relative to the stator. A valve device is provided in the rotor hub, the at least one switchable valve device in one operating position allowing the working chambers between which transfer of pressure medium is prevented by the check valve or between which no check valve is provided to be fluidically connected to each other.

9 Claims, 3 Drawing Sheets

(56) References Cited

U.S. PATENT DOCUMENTS

| | | | |
|---|---|---|---|
| 2003/0033999 | A1 | 2/2003 | Gardner et al. |
| 2005/0103297 | A1 | 5/2005 | Simpson et al. |
| 2005/0205032 | A1 | 9/2005 | Lehmann |
| 2006/0086332 | A1 | 4/2006 | Simpson et al. |
| 2011/0067657 | A1 | 3/2011 | Strauss |
| 2011/0214634 | A1 | 9/2011 | Yamaguchi et al. |
| 2013/0000578 | A1 | 1/2013 | Cole et al. |
| 2013/0032108 | A1 | 2/2013 | Kikuoka et al. |

FOREIGN PATENT DOCUMENTS

| | | |
|---|---|---|
| DE | 102008011915 | 9/2009 |
| DE | 102008011916 | 9/2009 |
| EP | 2508723 | 10/2012 |
| WO | WO2004/033860 | 4/2004 |
| WO | WO2012061233 | 5/2012 |

* cited by examiner

CAMSHAFT PHASER

The present invention relates to a camshaft phaser having.

BACKGROUND

Camshaft phasers are generally used in valve actuation systems of internal combustion engines to vary the valve opening and closing times, thereby making it possible to improve the fuel consumption figures of the internal combustion engine and the general operating characteristics.

One camshaft phaser design that has proven suitable in practice features a vane-type phaser having a stator and a rotor defining an annular space which is divided by projections and vanes into a plurality of working chambers. The working chambers can be selectively pressurized with a pressure medium which is fed by a pressure medium pump in a pressure medium circuit from a pressure medium reservoir into the working chambers on one side of the vanes of the rotor, and returned to the pressure medium reservoir from the working chambers on the respective other side of the vanes. The working chambers whose volume is thereby increased have a direction of action opposite to that of the working chambers whose volume is decreased. The direction of action accordingly means that pressurizing one of the groups of working chambers with pressure medium causes the rotor to rotate in a corresponding clockwise or counterclockwise direction relative to the stator. The flow of pressure medium, and thus the adjusting movement of the camshaft phaser, is controlled, for example, by a central valve having a complex system of flow passages and control edges and a valve body displaceable within the central valve to close or clear the passage openings as a function of its position.

One problem of such a camshaft phaser is that, during a starting phase, it is not yet completely filled with pressure medium, or may even have run empty, so that the rotor may perform uncontrolled movements relative to the stator as a result of the alternating torques exerted by the camshaft. Such uncontrolled movements may lead to increased wear and unwanted noise generation. To avoid this problem, it is known to provide a locking device between the rotor and the stator. When the internal combustion engine is stopped, this locking device locks the rotor relative to the stator in an angular position that is favorable for the starting procedure. In exceptional cases, for example when the engine stalls, it may happen that the locking device does not lock the rotor as intended, and that the camshaft phaser must be operated with the rotor unlocked during the following starting phase. However, since some internal combustion engines have very poor starting performance when the rotor is not locked in the central position, the rotor must then be automatically rotated to the central locking position and locked during the starting phase.

Such automatic rotation and locking of the rotor relative to stator is known, for example, from DE 10 2008 011915 A1 and DE 10 2008 011 916 A1. Both of the locking devices described therein include a plurality of spring-loaded locking pins, which successively lock in locking slots provided in the sealing cover or the stator during a rotation of the rotor. Before the central locking position is reached, the respective locking pins permit rotation of the rotor in a direction toward the central locking position, but inhibit rotation of the rotor in the opposite direction. After the internal combustion engine has warmed up and/or after the camshaft phaser has been completely filled with pressure medium, the locking pins are urged out of the locking slots under the action of the pressure medium, so that the rotor can then be rotated as intended to adjust the angular position of the camshaft relative to the stator.

BACKGROUND

A disadvantage of this approach is that the locking of the rotor can only be accomplished with a plurality of successively locking pins, which results in higher costs. Further, the locking operation requires that the locking pins reliably lock successively. If one of the locking pins does not lock, the locking operation may be interrupted because the rotor is consequently not unidirectionally locked in the intermediate position and may rotate back.

It is an object of the present invention to provide a camshaft phaser having reliable and inexpensive means for locking the rotor in a central position.

In accordance with the fundamental idea underlying the present invention, it is proposed that one or more of the vanes altogether have at least two pressure medium conduits provided therein which each fluidically connect two working chambers of different directions of action, the at least two pressure medium conduits having provided therein respective check valves of different directions of action which each allow the pressure medium to be transferred between the working chambers in one direction and prevent it from being transferred in the respective opposite direction, depending on the direction of rotation of the rotor relative to the stator, and that at least one switchable valve device be provided in the rotor hub, the at least one switchable valve device in one operating position allowing the working chambers between which transfer of pressure medium is prevented by the check valve or between which no check valve is provided to be fluidically connected to each other.

The solution proposed herein allows the rotor to rotate in one direction relative to the stator utilizing the alternating torques (Camshaft Torque Actuated, CTA) acting on the camshaft during the starting phase of the internal combustion engine, while rotation in the respective other direction is blocked by the respective check valve. In this way, a kind a freewheel device is implemented, which enables the rotor to automatically rotate from an advance or retard stop position toward the central locking position until it is finally locked in the central locking position. In order to prevent the movement of the rotor from being impeded at the same time by the pressure medium in the working chambers between which no check valve is provided that acts in the same direction, these working chambers are short-circuited by the switchable valve device that is provided. The switchable valve device is deliberately disposed in the rotor hub, so that the working chambers can be short-circuited by a single valve device and a suitable conduit system including a plurality of pressure medium conduits in the rotor.

It is also proposed that the working chamber into which the pressure medium flows via the check valve be fluidically decoupled from the pressure medium circuit by the switchable valve device. If the pressure medium can flow into a plurality of working chambers via a plurality of check valves acting in the same direction, then, of course, all of these working chambers are decoupled from the pressure medium circuit. In order to decouple the working chamber, the valve device closes off a pressure medium conduit opening into the working chamber, thereby preventing the pressure medium from flowing out of the working chamber. The solution proposed herein also prevents the ability of the rotor, after a rotational movement in one direction, to rotate back in the respective other direction. In this way, the freewheel function already provided by the check valve is further assisted by the ability of the rotor to support itself against the stator via the vane and the pressure medium contained in the closed-off working chamber.

Further, it is proposed that one of the vanes have provided therein two pressure medium conduits which each have a check valve and enable the pressure medium to be transferred between the working chambers in different directions. The solution proposed herein makes it possible to further reduce the design complexity, the pressure medium in this case being blocked from flowing out of one or the other of the working chambers, depending on the return movement of the rotor. In this way, the freewheel function is implemented at one vane and two opposite working chambers alone.

It is further proposed that the working chambers of different directions of action be fluidically separated from each other by the switchable valve device when the rotor is in the central locking position. The connection of the pressure chambers via the switchable valve device and the transfer of pressure medium via the check valves serve solely for the purpose of for locking the rotor in a central position. To be able to subsequently adjust the phase angle of the camshaft relative to the crankshaft with the desired accuracy, the working chambers have to be fluidically separated again. In this connection, transfer of pressure medium via the check valves is acceptable within narrow limits, because, in this case, the rotor phasing accuracy is ensured by the working chambers that are pressurizable with pressure medium and have no check valve disposed therebetween.

In accordance with another preferred embodiment of the present invention, it is proposed that the first switchable valve device include at least two spring-loaded linearly displaceable locking pins of the central-position locking device. The linearly movable locking pins serve to lock the rotor, for example, in a locking slot that is provided in the cover of the camshaft phaser and is stationary with respect to the stator. In order to lock the rotor, the linearly movable locking pins necessarily execute a displacement movement which is here at the same time used to actuate the freewheel device; i.e., to fluidically couple and decouple the working chambers. Since the displacement movement of the locking pin at the same time causes the locking of the rotor relative to the stator, the switching instant of the valve device always coincides with the instant of locking, which makes it possible to achieve a very simple and also highly accurate control of the first valve device.

In this case, it is further proposed that the locking pins each be disposed between two sections of a pressure medium conduit and have grooves or bores via which the sections of the pressure medium conduit are fluidically connectable to each other, depending on the position of the locking pin. The grooves or bores on the locking pin, in effect, constitute flow-transfer channels via which the two sections of the pressure medium conduit are fluidically connected to each other.

It is further proposed that the first switchable valve device include at least one spring-loaded linearly displaceable valve function pin. In contrast to the locking pins, the valve function pin serves only to short-circuit the working chambers and is spring-loaded toward an engaged position in the locking slot, in which it establishes a fluid connection between the working chambers of different directions of action. It is only after pressurizing the locking slot that the valve function pin is urged out of the locking slot into an out-of-engagement position in which the fluid connection between the working chambers of different directions of action is interrupted and the short-circuit is removed.

It is further proposed that at least one of the vanes have provided therein a second switchable valve device which allows the flow of pressure medium to the check valves to be selectively blocked or enabled, depending on the position of the second valve device. The solution proposed herein makes it possible to, in effect, deactivate the check valves, so that, during normal operation, the pressure medium is prevented from being transferred between the working chambers and the phasing accuracy is further improved.

It is also proposed that the rotor hub have provided therein one or more partial ring-shaped or ring-shaped pressure medium conduits into which open at least some of the pressure medium conduits leading to the working chambers, and that the first switchable valve device be disposed in a pressure medium conduit that fluidically connects the two partial ring-shaped or ring-shaped pressure medium conduits. The solution proposed herein makes it possible to achieve a readily producible routing configuration of the pressure medium conduits, which in particular allows a plurality of working chambers of one direction of action to be short-circuited to a group of working chambers of a different direction of action via a single switchable valve device.

BRIEF DESCRIPTION OF THE DRAWINGS

The present invention will now be described in more detail by way of an exemplary embodiment. In the drawings.

DETAILED DESCRIPTION

Figure 1:
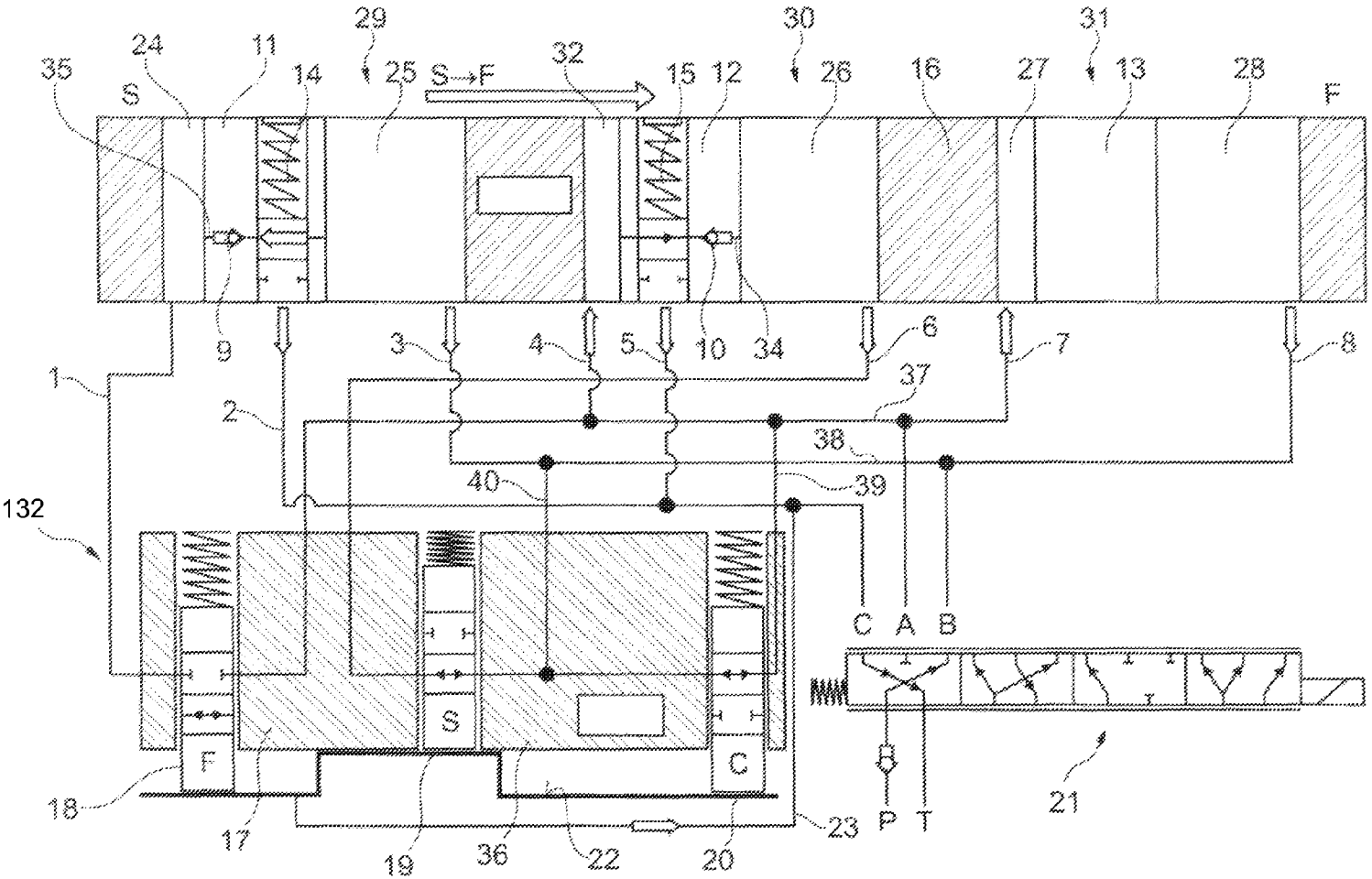
FIG. 1 is a schematic view showing an inventive camshaft phaser and a circuit diagram of a pressure medium circuit in a condition during an adjusting movement of the rotor in a direction from a retard position toward the central locking position.
Figure 2:
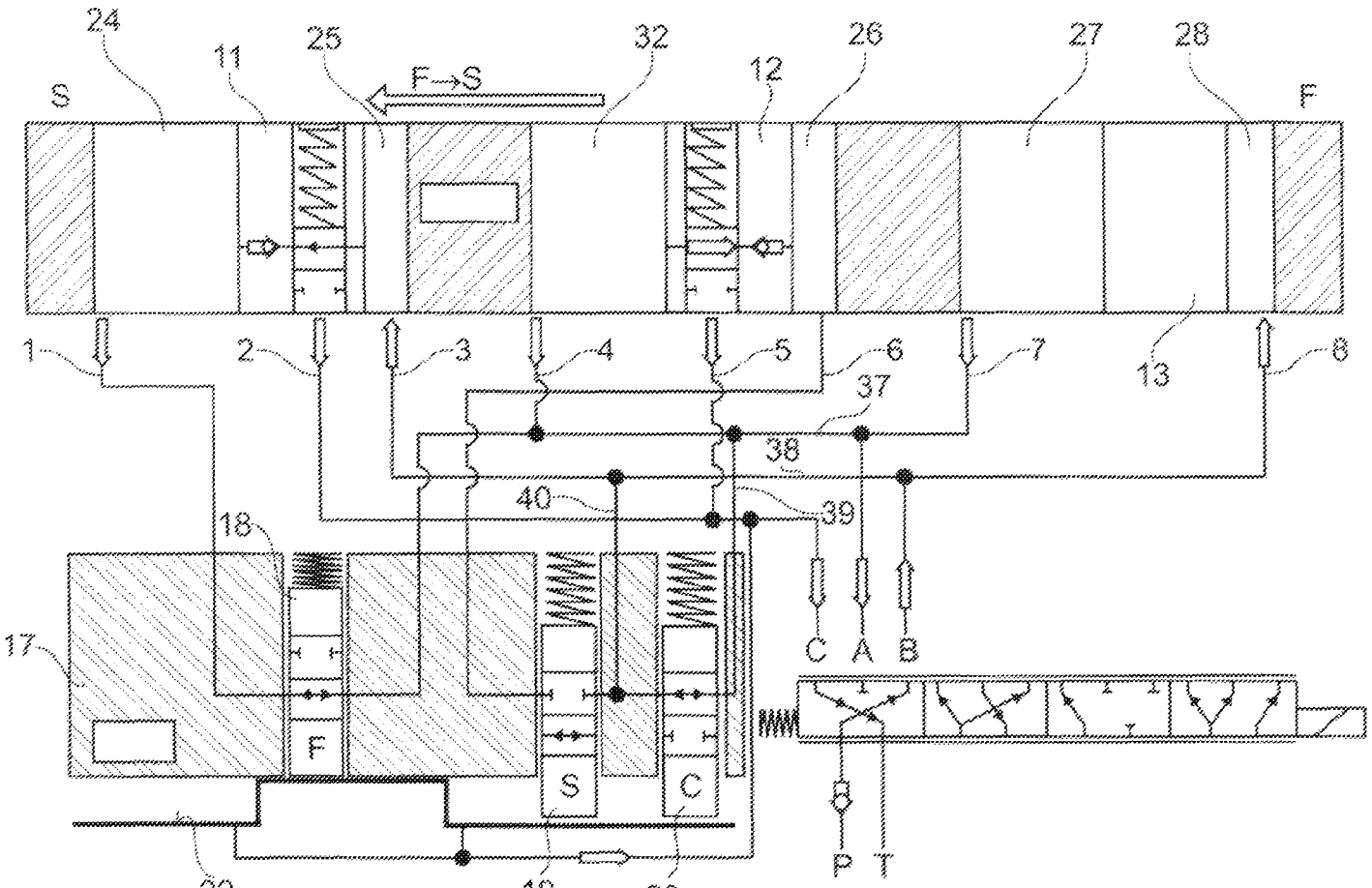
FIG. 2 is a schematic view showing an inventive camshaft phaser and a circuit diagram of a pressure medium circuit in a condition during an adjusting movement of the rotor in a direction from an advance position toward the central locking position.
Figure 3:
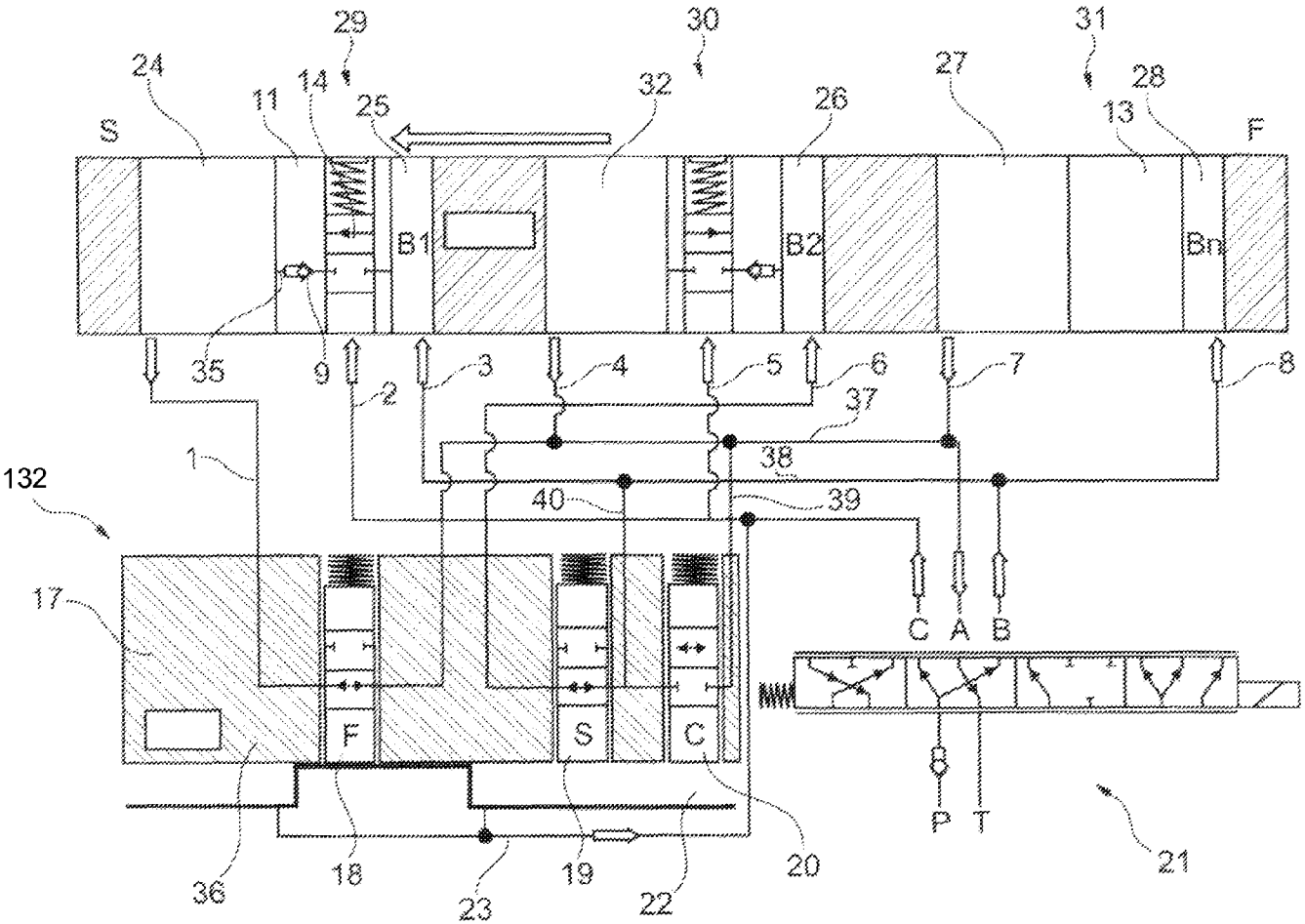
FIG. 3 is a schematic view showing an inventive camshaft phaser and a circuit diagram of a pressure medium circuit during the adjusting movement during normal operation.

In FIGS. 1 through 3, there is shown a camshaft phaser whose basic design is known in the art and which has, as a basic component, a schematically illustrated vane-type phaser including a stator 16 capable of being driven by a crankshaft and a rotor 17 which is non-rotatably connectable to a camshaft and has a rotor hub 36 and a plurality of vanes 11, 12 and 13 extending radially outwardly therefrom. The upper view shows the vane-type phaser in a developed representation. The lower left view schematically shows a portion of rotor hub 36 of rotor 17 including a central-position locking device 132, and the lower right view schematically shows a multi-way control valve 21 for controlling the pressure medium flow.

Also shown is a pressure medium circuit having a plurality of pressure medium conduits 1, 2, 3, 4, 5, 6, 7, 8, 23, 37, 38, 39 and 40, which are selectively fluidically connectable via multi-way control valve 21 to a pressure medium pump P or a pressure medium reservoir T. Pressure medium pump P feeds the pressure medium back into the pressure medium circuit from pressure medium reservoir T after it has been returned thereto.

Stator 16 has a plurality of stator lobes dividing an annular space between stator 16 and rotor 17 into a plurality of pressure chambers 29, 30 and 31. Pressure chambers 29, 30 and 31 are in turn divided by vanes 11, 12 and 13 of rotor 17 into working chambers 24, 25, 26, 27, 28 and 32 into which open pressure medium conduits 1, 3, 4, 6, 7 and 8. Central-position locking device 132 includes two locking pins 18 and 19, which lock in a locking slot 22 that is fixed with respect to stator 16 in order to lock rotor 17 relative to stator 16. Locking slot 22 may be provided, for example, in a sealing cover threaded to stator 16.

Basically, during normal operation, the phase angle of the camshaft relative to the crankshaft is shifted, for example, in the advance direction, by pressurizing working chambers 24, 32 and 27 with pressure medium, thereby increasing their volume, while at the same time displacing the pressure medium from working chambers 25, 26 and 28, thereby decreasing the volume. In the context of the present invention, the working chambers 24, 25, 26, 27, 28 and 32 whose volume is increased in groups during this adjusting movement are referred to as working chambers 24, 25, 26, 27, 28 and 32 of one direction of action, while the working chambers 24, 25, 26, 27, 28 and 32 whose volume is at the same time decreased are referred to as working chambers 24, 25, 26, 27, 28 and 32 of the opposite direction of action. The change in the volume of working chambers 24, 25, 26, 27, 28 and 32 then causes rotor 17 to be rotated with its vanes 11, 12 and 13 relative to stator 16. In the upper view of FIG. 3, the volume of working chambers 25, 26 and 28 is increased by pressurizing them with pressure medium via the B-port of multi-way control valve 21, while the volume of working chambers 24, 32 and 27 is at the same decreased by the return flow of the pressure medium via the A-port of multi-way control valve 21. This change in volume then causes rotor 17 to rotate relative to stator 16, which results in a movement of vanes 11, 12 and 13 in the direction of the arrow toward the left in the developed view. Further provided is a valve function pin 20 which is also linearly displaceable and spring-loaded. Valve function pin 20 is spring-loaded toward the engaged position in locking slot 22 and disposed on rotor 17 in such a way that it does not hinder rotation of rotor 17 relative to stator 16. Valve function pin 20 is, in effect, only carried along. To enable rotor 17 to move relative to stator 16, central-position locking device 132 is first released by pressurizing locking slot 22 with pressure medium via pressure medium conduits 2 and 23 from the C-port of multi-way control valve 21 by means of pump P. The pressurization of locking slot 22 with pressure medium causes locking pins 18 and 19 and valve function pin 20 to be urged out of locking slot 22, so that rotor 17 can then freely rotate relative to stator 16. To this extent, the camshaft phaser is similar to the prior art.

In the approach of the present invention, vanes 11 and 12 have provided therein respective pressure medium conduits 34 and 35 containing respective check valves 9 and 10 which enable transfer of pressure medium from working chamber 25 to working chamber 24 and from working chamber 32 to working chamber 26. Furthermore, the flow of pressure medium through pressure medium conduits 34 and 35 can be blocked or enabled by a respective second switchable spring-loaded valve device 14 and 15. To this end, switchable valve devices 14 and 15 have two operating positions in which flow therethrough is either enabled or blocked. Switchable second spring-loaded valve devices 14 and 15 are each capable of being pressurized with pressure medium via respective pressure medium conduits 2 and 5. Upon pressurization with pressure medium, second spring-loaded valve devices 14 and 15 are moved from the first operating position to the second operating position shown in FIG. 3 by displacement of respective valve bodies against the spring force. In the second operating position, the flow through pressure medium conduits 34 and 35 is blocked, so that working chambers 24 and 25, respectively 32 and 26, are considered to be separated from each other, and the camshaft phaser can be operated without any transfer of pressure medium between working chambers 24, 25, 32 and 26 and with a correspondingly high phasing accuracy.

Central-position locking device 132 includes two locking pins 18 and 19 which, together with valve function pin 20, form a switchable first valve device in rotor hub 36. To this end, locking pins 18 and 19 and valve function pin 20 are configured as spring-loaded valve bodies which have suitable grooves or bores and are capable of being moved against the spring force from a first to a second operating position by pressurizing locking slot 22 via pressure medium conduit 23. Locking pins 18 and 19 and valve function pin 20 are in the first operating position when they engage in locking slot 22 and the springs are relaxed.

The bores or grooves in locking pin 18 are disposed in such a manner that when locking pin 18 is in the first operating position and the spring is relaxed, the flow of pressure medium between pressure medium conduit 1 and pressure medium conduits 37 and 4 is blocked, as can be seen from the position shown in FIG. 1. This position exists when, during the starting of the internal combustion engine, rotor 17 is not locked in the central locking position, but rotated relative to stator 16 toward the retard stop position. In the figure, the retard stop position is denoted by S and the advance stop position is denoted by F. At the same time, locking pin 19 does not engage in locking slot 22 and thus has been moved into the second operating position against the spring force. The bores or grooves in locking pin 19 are disposed in such a manner that when locking pin 19 is in the second operating position, it enables the flow of pressure medium between pressure medium conduits 6 and 40. Pressure medium conduits 6 and 40 are fluidically connected to working chambers 25, 26 and 28, which are thereby short-circuited. Pressure medium conduits 3 and 8 open into a partial ring-shaped or ring-shaped pressure medium conduit 38 at rotor hub 36, which in turn is fluidically connected to locking pin 19 via pressure medium conduit 40. Partial ring-shaped or ring-shaped pressure medium conduit 38 allows locking pin 19 to be fluidically connected to pressure medium conduits 3 and 8 via a single pressure medium conduit 40, which makes it possible to simplify the conduit routing and the short-circuiting of working chambers 25, 26 and 28. Furthermore, valve function pin 20 is in the first operating position in which the bore or groove provided on valve function pin 20 establishes a fluid connection between pressure medium conduits 40 and 39, so that the working chambers 32 and 26 of pressure chamber 30 and the working chambers 27 and 28 of pressure chamber 31 that have different directions of action are short-circuited. Moreover, pressure medium conduits 4 and 7 open into partial ring-shaped or ring-shaped pressure medium conduit 37 at rotor hub 36, which in turn is fluidically connectable to locking pin 20 via pressure medium conduit 39. In this position, the short-circuit through valve function pin 20 is established by connecting pressure medium conduits 39 and 40; i.e., by short-circuiting partial ring-shaped or ring-shaped pressure medium conduits 37 and 38. In this position, there is no pressurization with pressure medium via multi-way control valve 21, and outflow of pressure medium via the A- and B-ports of multi-way control valve 21 is blocked.

In the case that the camshaft phaser is not locked in the central locking position during the starting of the internal combustion engine, rotor 17 is automatically rotated from the position shown in FIG. 1 in a direction from retard stop position (S) toward the central locking position in the direction of the arrow by using the alternating torques (Camshaft Torque Actuated, CTA) acting on the camshaft to enable the pressure medium to flow from working chamber 25 through pressure medium conduit 35 and check valve 9 into working chamber 24. In this connection, since the other working chambers 32, 26, 27 and 28 are short-circuited in this position, the adjusting movement is not hindered by the pressure medium present therein. Since, moreover, the pressure medium is unable to flow out of working chamber 24 and to return through check valve 9 into working chamber 25, rotor 17 is at the same time unable to rotate back toward retard stop position (S). Thus, rotor 17, in effect, supports itself against the pressure medium present in working chamber 24, the volume of working chamber 24 being increased by the pulsating inflow of pressure medium through check valve 9, thereby rotating rotor 17 relative to stator 16. Thus, check valve 9 and the correspondingly blocked or opened pressure medium conduits 1, 3, 4, 6, 7 and 8 together constitute a freewheel device by which rotor 17 is rotated unidirectionally relative to stator 16 toward the central locking position utilizing the alternating camshaft torques until locking pin 19 engages in locking slot 22 and locking pin 18 abuts laterally against a stop of locking slot 22, respectively. Through the engagement of the locking pin 19 in locking slot 22, locking pin 19 is automatically moved, under the action of the spring force, into the first operating position in which the previously open fluid connection between pressure medium conduits 6, 3 and 8 is blocked and the short-circuit created by the previously open fluid connection is removed. In this way, rotor 17 is prevented from rotating further relative to stator 16 and is locked in the central locking position. It is of particular importance for the proper functioning of the freewheel device that the working chambers 32 and 26 of pressure chamber 30 and the working chambers 27 and 28 of pressure chamber 31 that have different directions of action be short-circuited through the groove or the bore of the valve function pin 20 in the first operating position to thereby allow free transfer of the pressure medium present therein.

FIG. 2 illustrates the reverse adjustment in a direction from advance stop position (F) toward the central locking position. The principle of the adjusting movement remains the same. In this case, locking pin 18 is in the second operating position and thus establishes a fluid connection between pressure medium conduits 1, 4 and 7, thereby short-circuiting working chambers 24, 32 and 27. Furthermore, locking pin 19 is in the first operating position and thus blocks the flow therethrough of pressure medium from working chamber 26 via pressure medium conduit 6 to pressure medium conduits 3 and 8, so that working chamber 26 is decoupled from the pressure medium circuit. In this case, when alternating torques occur during the starting phase of the internal combustion engine, the pressure medium flows from working chamber 32 via pressure medium conduit 34 and the check valve 10 disposed therein into working chamber 26, thereby increasing the volume thereof because, at the same time, outflow of pressure medium is prevented by the blocked pressure medium conduit 6.

It is of particular importance to the present invention that the working chambers 24, 25, 26, 27, 28 and 32 of different directions of action that do not form part of the currently active freewheel device be short-circuited by the first switchable valve device formed by valve function pin 20 in order for the automatic adjusting movement not to be hindered by the pressure medium present in working chambers 24, 25, 26, 27, 28 and 32. In this connection, it is particularly advantageous that valve function pin 20 is disposed in rotor hub 36 because the arrangement of the pressure medium conduits short-circuited by valve function pin 20 can thereby be considerably simplified. In the solution proposed herein, this is achieved by providing partial ring-shaped or ring-shaped pressure medium conduits 37 and 38, into which open pressure medium conduits 3 and 8, respectively 4 and 7. The short-circuit through valve function pin 20 is then established solely by short-circuiting the two pressure medium conduits 39 and 40, which each open into partial ring-shaped or ring-shaped pressure medium conduits 37 and 38, respectively. Partial ring-shaped or ring-shaped pressure medium conduits 37 and 38 may be implemented as circumferential grooves, whereby the design complexity can be considerably simplified.

LIST OF REFERENCE NUMERALS

1 pressure medium conduit
2 pressure medium conduit
3 pressure medium conduit
4 pressure medium conduit
5 pressure medium conduit
6 pressure medium conduit
7 pressure medium conduit
8 pressure medium conduit
9 check valve
10 check valve
11 vane
12 vane
13 vane
14 2-way valve
15 2-way valve
16 stator
17 rotor
18 locking pin
19 locking pin
20 valve function pin
21 multi-way control valve
22 locking slot
23 pressure medium conduit
24 working chamber
25 working chamber
26 working chamber
27 working chamber
28 working chamber
29 pressure chamber
30 pressure chamber
31 pressure chamber
32 working chamber
132 central-position locking device
34 pressure medium conduit
35 pressure medium conduit
36 rotor hub
37 pressure medium conduit
38 pressure medium conduit
39 pressure medium conduit
40 pressure medium conduit

What is claimed is:

1. A camshaft phaser comprising:

a vane-type phaser having a stator connectable to a crankshaft of an internal combustion engine, and a rotor rotatably mounted in the stator and connectable to a camshaft, the stator being provided with a plurality of lobes dividing an annular space between the stator and the rotor into a plurality of pressure chambers, the rotor having a rotor hub and a plurality of vanes extending radially outwardly from the rotor hub and dividing the pressure chambers into two groups of working chambers of different directions of action, said working chambers each being capable of being pressurized with a pressure medium flowing in and out in a pressure medium circuit, and a central-position locking device for locking the rotor in a central locking position relative to the stator, wherein one or more of the vanes altogether have at least two pressure medium conduits provided therein which each fluidically connect two working chambers of different directions of action, and the pressure medium conduits having provided therein respective check valves of different directions of action which each allow the pressure medium to be transferred between the working chambers in one direction and prevent it from being transferred in the respective opposite direction, depending on the direction of rotation of the rotor relative to the stator, and at least one switchable valve device is provided in the rotor hub, the at least one switchable valve device in one operating position allowing the working chambers between which transfer of pressure medium is prevented by the check valve or between which no check valve is provided to be fluidically connected to each other.

2. The camshaft phaser as recited in claim 1 wherein the working chamber into which the pressure medium flows via the check valve is fluidically decoupled from the pressure medium circuit by the first switchable valve device.

3. The camshaft phaser as recited in claim 1 wherein one of the vanes has provided therein two pressure medium conduits which each have a check valve and enable the pressure medium to be transferred between the working chambers in different directions.

4. The camshaft phaser as recited in claim 1 wherein the working chambers of different directions of action are fluidically separated from each other by the first switchable valve device when the rotor is in the central locking position.

5. The camshaft phaser as recited in claim 1 wherein the first switchable valve device includes at least two spring-loaded linearly displaceable locking pins of the central-position locking device.

6. The camshaft phaser as recited in claim 5 wherein the locking pins are each disposed between two sections of a pressure medium conduit and have grooves or bores via which the sections of the pressure medium conduit are fluidically connectable to each other, depending on the position of the locking pin.

7. The camshaft phaser as recited in claim 1 wherein the first switchable valve device includes at one spring-loaded linearly displaceable valve function pin.

8. The camshaft phaser as recited in claim 1 wherein at least one of the vanes has provided therein a second switchable valve device allowing the flow of pressure medium to the check valves to be selectively blocked or enabled, depending on the position of the valve device.

9. The camshaft phaser as recited in claim 1 wherein the rotor hub has provided therein at least one partial ring-shaped or ring-shaped pressure medium conduit into which open at least some of the pressure medium conduits leading to the working chambers, and the first switchable valve device is disposed in a pressure medium conduit fluidically connecting the two partial ring-shaped or ring-shaped pressure medium conduits.

* * * * *